US005795127A

United States Patent [19]

DeClerck

[11] Patent Number: 5,795,127

[45] Date of Patent: Aug. 18, 1998

[54] VERTICAL SHAFT SELF-PRIMING CENTRIFUGAL PUMP

[75] Inventor: David M. DeClerck, Utica, Mich.

[73] Assignee: Tecumseh Products Company, Tecumseh, Mich.

[21] Appl. No.: 732,701

[22] Filed: Oct. 18, 1996

Related U.S. Application Data

[60] Provisional application No. 60/006,521, Oct. 20, 1995.

[51] Int. Cl.[6] ..... F04B 17/00

[52] U.S. Cl. ..... 415/106; 417/364

[58] Field of Search ..... 417/424.1, 364; 415/104, 106, 228

[56] References Cited

U.S. PATENT DOCUMENTS

| | | | |
|---|---|---|---|
| 750,846 | 2/1904 | Goth . | |
| 1,382,665 | 6/1921 | Myers . | |
| 1,970,371 | 8/1934 | Frantz | 417/364 |
| 2,022,624 | 11/1935 | Longenecker . | |
| 2,292,529 | 8/1942 | Labour . | |
| 3,160,108 | 12/1964 | Sence | 415/106 |
| 3,276,384 | 10/1966 | Boone . | |
| 3,434,430 | 3/1969 | Berman . | |
| 3,487,786 | 1/1970 | Danner . | |
| 3,741,675 | 6/1973 | Porter . | |
| 3,771,910 | 11/1973 | Laing . | |
| 3,847,504 | 11/1974 | Martin . | |
| 4,201,524 | 5/1980 | Wilkins | 417/364 |
| 4,243,357 | 1/1981 | Flynn et al. | 415/228 |
| 4,538,960 | 9/1985 | Iino . | |
| 4,775,291 | 10/1988 | Culbertson . | |
| 5,104,284 | 4/1992 | Hustak, Jr. . | |
| 5,320,482 | 6/1994 | Palmer . | |

*Primary Examiner*—Richard E. Gluck
*Attorney, Agent, or Firm*—Baker & Daniels

[57] ABSTRACT

A self-priming, vertical-shaft centrifugal pump having an impeller design which creates an upward thrust and which is heavy enough to carry an engine having a standard weight flywheel through a compression stroke. The pump is comprised of a vertical-shaft engine mounted onto a pump housing. The pump housing includes an inlet chamber, a pumping chamber, and a separation chamber. The shaft of the engine protrudes into the pumping chamber and is mounted to an impeller which rotates within the pumping chamber. The pump draws liquid into the pumping chamber from an inlet communicating liquid entrained with gas to the pump. The impeller uses centrifugal force to pump the liquid and gas mixture out of the pumping chamber and into the separation chamber. In the separation chamber, the entrained gas is removed from the liquid and exhausted into the atmosphere, and the liquid is communicated back into the pumping chamber to mix with additional liquid entrained with gas until all of the entrained gas from the incoming mixture is removed. To reduce the axial load on the bearings of the engine, a pressure space is provided below the impeller shroud which is in communication with the high pressure fluid expelled by the impeller. The high pressure space pushes the impeller upward to thereby lessen the load on the engine bearings. The shroud of the impeller is sufficiently heavy to carry the engine through a compression stroke so that an engine having a standard weight, less expensive flywheel can be used.

6 Claims, 4 Drawing Sheets

VERTICAL SHAFT SELF-PRIMING CENTRIFUGAL PUMP

CROSS-REFERENCE TO RELATED APPLICATION

This application claims the benefit under Title 35, U.S.C. § 119(e) of U.S. Provisional patent application Ser. No. 60/006,521, entitled VERTICAL SHAFT SELF-PRIMING CENTRIFUGAL PUMP, filed on Oct. 20, 1995.

BACKGROUND OF THE INVENTION

1. Field of the Invention

The present invention generally relates to pumps, and more particularly relates to centrifugal pumps.

2. Description of the Related Art

With certain centrifugal pumps, it is necessary to fill the pump with the liquid that is to be pumped prior to operation. If a centrifugal pump is run without first being filled with a liquid, the internal parts of the pump requiring liquid lubrication can be damaged or rendered unusable. This process of filling a centrifugal pump with a liquid before operation is referred to as "priming" and if the pump is above the level of the liquid to be pumped, the pump must be "self-priming." Self-priming pump capability requires the pump to be able to remove gases entrained with the liquid from a suction inlet leading to the pump. If the gases are not totally removed from the suction inlet, the pump will not be able to function effectively and efficiently as there will be air pockets in the incoming flow of liquid which will interrupt the flow of the fluid being pumped.

The separation of the liquid and gas has typically been performed in a separation chamber of the pump which employs gravity for separation of the gas from the liquid. For example, U.S. Pat. No. 2,022,624 discloses a pump having a horizontal shaft engine, wherein the fluid being pumped flows vertically or upward from the impeller. The fluid is then at a height sufficiently high to allow gravity to separate the gas from the liquid by having the liquid flow downward and the gas flow upward.

However, given the mass production of vertical shaft engines, as well as the more complicated mounting hardware associated with horizontal shaft engines, vertical shaft engines are considerably less expensive than horizontal shaft engines. Consequently, it would be advantageous to have a self-priming pump which uses a vertical shaft engine to separate the liquid from the gas. U.S. Pat. No. 2,292,529 discloses a vertical shaft engine to power a self-priming pump. However, with such a device the weight of the engine and the impeller is entirely supported by the engine bearings. This may result in either premature fatigue of the engine bearings or may necessitate the use of specially designed bearings, at additional expense, to support the axial load resulting from the weight of the engine and impeller.

Moreover, typical centrifugal pumps employ two-stroke engines to power the pump. Such engines use a heavy flywheel, at additional expense, to carry the engine through its compression stroke.

SUMMARY OF THE INVENTION

The present invention is a self-priming pump which satisfies the above-identified needs by using a vertical shaft engine to power the pump, and an impeller design which creates an upward thrust which counteracts the downward axial load of the engine and impeller to thereby enable the vertical shaft engine bearings to handle the axial load resulting from the impeller and engine. The present invention also uses a weighted impeller so that an engine having a standard weight, less expensive flywheel can be used.

The present invention is comprised of a vertical shaft engine wherein an impeller is mounted to the shaft. When the shaft is rotated, the impeller generates a centrifugal force which forces the incoming fluid to the outer periphery of the housing surrounding the impeller. The fluid flows horizontally outward from the impeller and into a separation chamber. In the separation chamber, the entrained gas is separated from the liquid and the liquid in turn is put back into the impeller to mix with additional liquid entrained with gas until substantially all gases are removed from the inlet to the pump.

To reduce the axial load on the engine bearings, the impeller includes a shroud placed on the side of the impeller opposite the engine. A pressure space thereby exists between the bottom of the shroud and the pump housing. The high-pressure liquid expelled by the impeller is communicated to the pressure space. Since the liquid in the pressure space has a higher pressure than the liquid flowing across the top of the impeller, an upward thrust is created which pushes the impeller upward and thereby lessens the downward load on the engine bearings. This design reduces the load on the bearings in magnitude because the impeller generates an upward thrust to counteract against the downward axial load resulting from the weight of the engine.

One advantage of the present invention is that the impeller design reduces the axial load on the engine bearings by creating an upward thrust to counteract the downward axial load of the engine and impeller. The engine bearings are thereby able to better accept the downward axial load resulting from the weight of the engine and impeller.

Another advantage of the present invention is that the overall cost of the self-priming pump is reduced through the use of a vertical shaft engine having a standard weight flywheel.

The present invention, in one form, provides a centrifugal pump comprising an engine, a pump housing, and an impeller. The engine has a vertically disposed drive shaft rotatably mounted within bearings and extending downwardly into the pump housing. The impeller is attached to the vertical drive shaft and is rotatable within the pump housing with the impeller and shaft placing a downward load on the engine bearings. The impeller includes a central aperture, an outer circumference, a shroud and a plurality of vanes. The shroud is perpendicular to the drive shaft and includes a first side and an opposed second side with the first side disposed adjacent the engine. A plurality of vanes are radially disposed on the first side. The second side is disposed adjacent the pump housing with a pressure space disposed between the second side and the pump housing. Fluid is pumped through the impeller central aperture and is expelled radially outward by the vanes disposed on the impeller to the outer circumference of the impeller. Fluid between the central aperture and the outer circumference has a lower pressure than fluid at the outer circumference with the pressure area being in fluid communication with the fluid at the outer circumference and thereby having a relatively high pressure. The high pressure area thereby places an upward thrust on the second side of the impeller to counteract against the downward load resulting from the shaft and impeller. The downward load on the engine bearings is thereby reduced.

The present invention, in another form thereof, provides a centrifugal pump comprising an engine, a pump housing, and an impeller. The engine has a vertically disposed drive shaft, a standard weight flywheel, and is attached to the housing such that the driveshaft extends downwardly into the pump housing. The impeller is attached to the vertical drive shaft and is rotatable within the pump housing. The impeller includes a plurality of vanes which engage a medium being pumped and force the medium radially outward upon rotation of the impeller. The impeller has a weight sufficient to carry the engine through a compression stroke.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention in one form and such exemplification is not to be construed as limiting the scope of the invention in any manner.

DETAILED DESCRIPTION OF THE INVENTION

Figure 1:
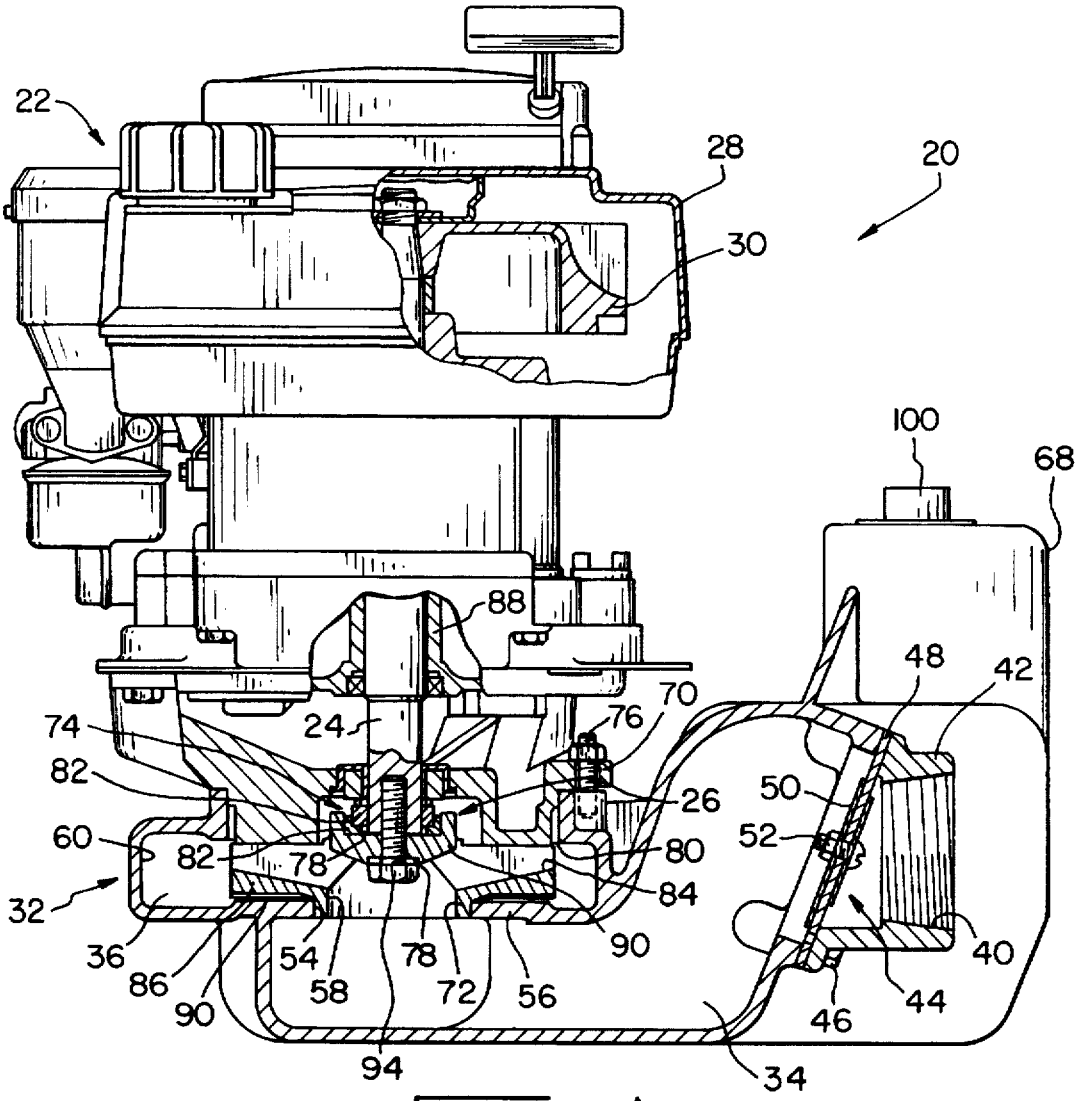
FIG. 1 is a partial sectional view of the present invention.
Figure 6:
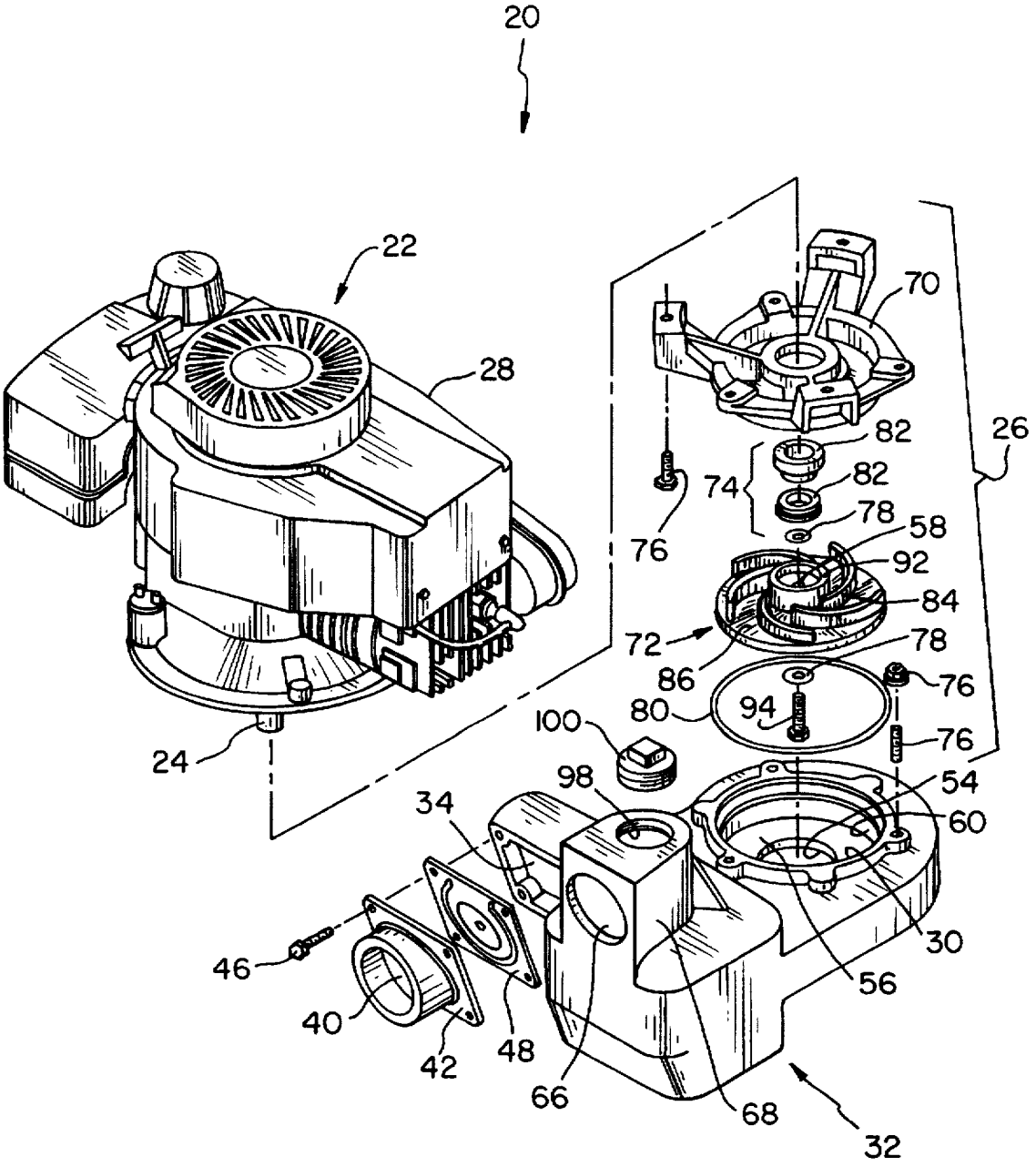
FIG. 6 is an exploded perspective view of the invention shown in FIG. 1.

Referring now to FIGS. 1 and 6, the present invention is generally depicted as vertical shaft pump 20. The primary mover, engine 22, is shown having vertical shaft 24 to which impeller assembly 26 is mounted. Engine 22 also includes housing 28 which encloses flywheel 30 (FIG. 1). Vertical shaft engines are commonly available in the art and a 3.8 horsepower "Vantage" Model No. TVS90, manufactured by Tecumseh Products Company, is provided as an example. Engine 22 is mounted to pump housing 32 such that shaft 24 vertically extends from engine 22 into pump housing 32.

Figure 4:
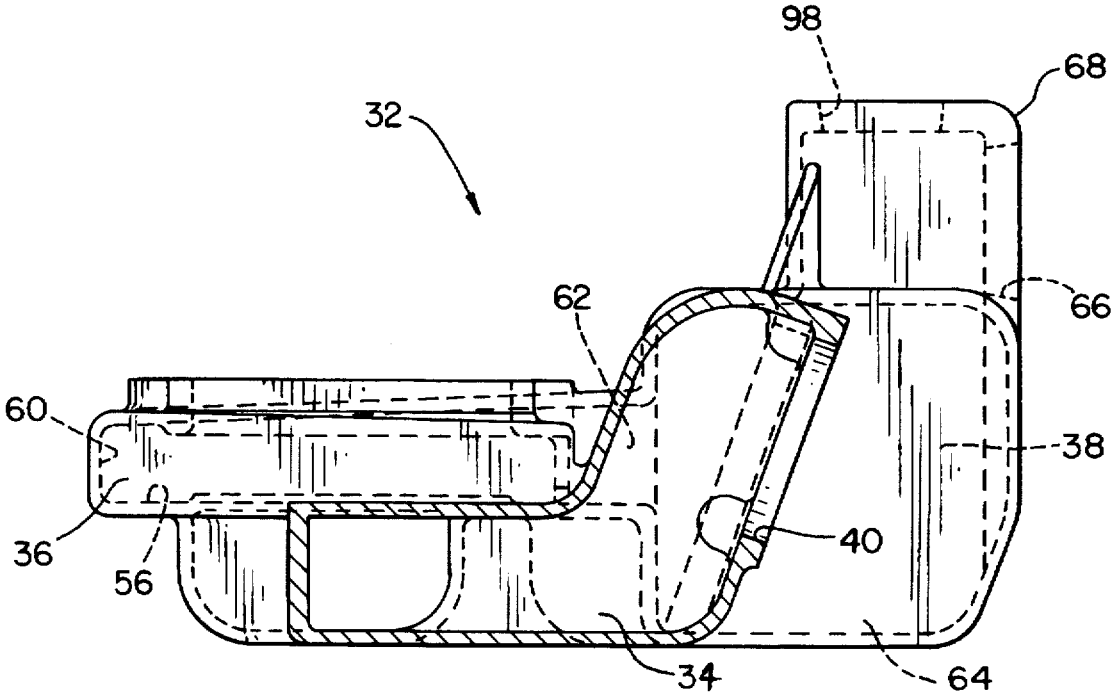
FIG. 4 is a partial sectional view of the pump housing taken along line 4—4 of FIG. 5.
Figure 5:
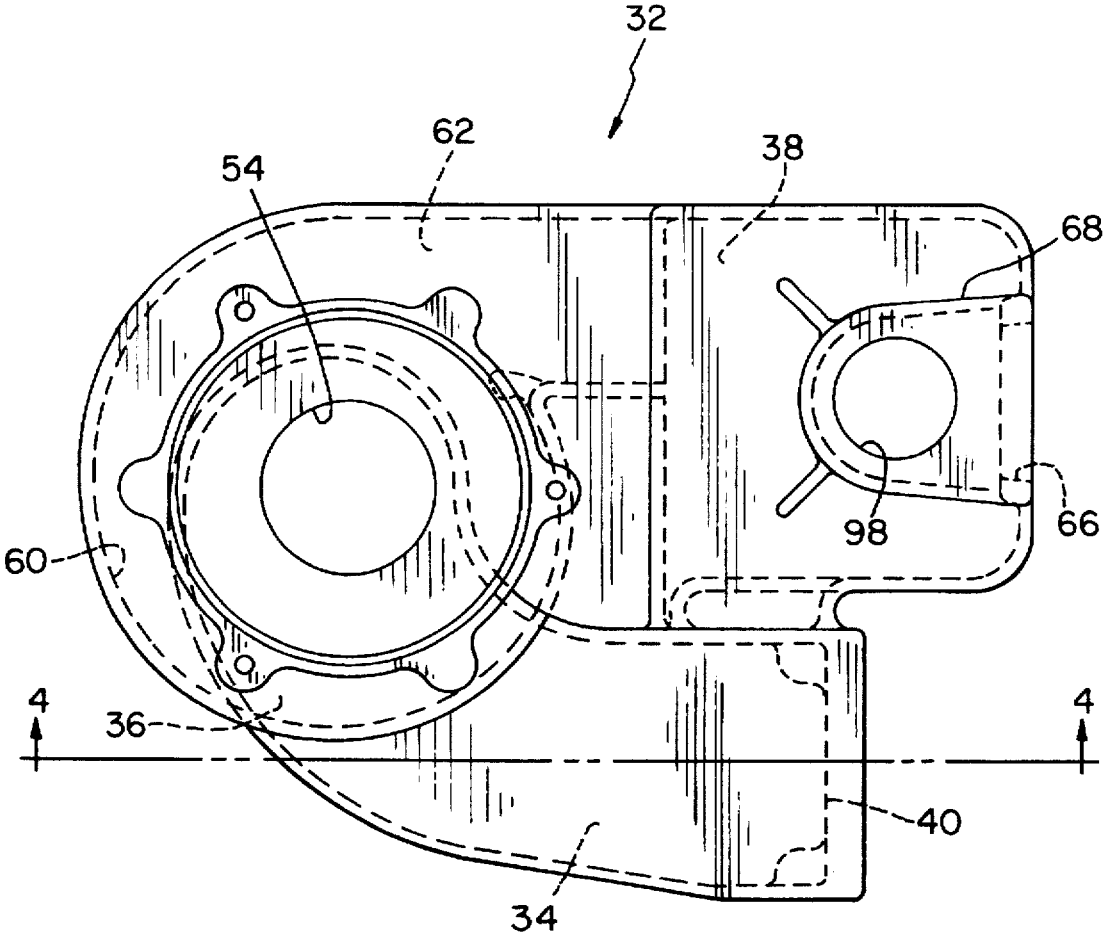
FIG. 5 is a top view of the pump housing shown in FIG. 1.

Pump housing 32 is described with more complete detail with reference to FIGS. 4 and 5. Pump housing 32 is comprised of three distinct chambers, pump inlet chamber 34, pumping chamber 36, and separation chamber 38. Pump inlet chamber 34 is provided with a pump inlet 40 to which a suction hose or other means (not shown) for providing a liquid to be pumped is attached. Pump inlet chamber 34 communicates with, and is provided adjacent to, the base of pumping chamber 36. As shown in FIGS. 1 and 6, the outside of pump inlet 40 is provided with a suction flange 42, flapper assembly 44 and fastening screws 46. Suction flange 42 allows for threaded or other suitable means for connecting a suction hose (not shown), whereas flapper assembly 44 serves as a check valve which prevents backflow of the fluid being pumped. As best shown in FIG. 1, flapper assembly 44 consists of elastomeric member 48 to which metal plates 50 are affixed via fastener 52. Flapper member 48 moves into the pump housing when sufficient suction pressure is present, and is elastically biased to the position shown in FIG. 1 otherwise to thereby prevent the fluid from flowing back through pump inlet 40.

Pumping chamber 36 is above pump inlet chamber 34 and serves as the chamber in which impeller assembly 26 rotates. Central aperture 54 is provided in bottom wall 56 of pumping chamber 36 for communicating liquid from pump inlet chamber 34 into pumping chamber 36. The liquid to be pumped therefore enters pumping chamber 36 through central aperture 54 of bottom wall 56 and thereby into center aperture 58 of impeller assembly 26. Rotation of impeller assembly 26 generates a centrifugal force which causes the liquid to move to the outer circumference of impeller assembly 26 whereat the liquid is redirected by curved wall 60. The liquid being pumped then exits pumping chamber 36 through diffuser passage 62.

In specific reference to FIG. 4, separation chamber 38 is shown directly adjacent and in communication with diffuser passage 62. Given that engine 22 and shaft 24 are mounted vertically, and impeller assembly 26 is therefore horizontal, the liquid being pumped exits impeller assembly 26 in a horizontal direction, passes through diffuser passage 62 in a horizontal direction, and enters separation chamber 38 in a horizontal direction. Since separation chamber 38 extends from the base of pump inlet chamber 34 to a distance substantially above the top of pumping chamber 36, and diffuser passage 62 communicates with separation chamber 38 at the approximate halfway point of the separation chamber 38, the liquid being expelled by impeller assembly 26 through diffuser passage 62 enters separation chamber 38 and is immediately pulled toward the base of separation chamber 38 due to gravity.

Quiet zone 64 is the internal space of separation chamber 38 wherein the liquid falls after being expelled from diffuser passage 62. In quiet zone 64, the difference in densities between the gas and the liquid allows the gas to rise and separate from the liquid and exit pump 20 through pump outlet 66. The liquid then reenters pumping chamber 36 to mix with additional liquid entrained with gas which enters through the aforementioned suction hose. Once all the entrained gas has been removed from the incoming liquid, the flow rate of pump 20 will naturally accelerate, forcing more liquid into separation chamber 38 and ultimately into tower 68 to allow for the liquid to exit pump 20 through pump outlet 66 (FIG. 6).

As shown in FIGS. 1 and 6, impeller assembly 26 is mounted to shaft 24 and rotates within pumping chamber 30. Impeller assembly 26 is comprised of adapter 70, impeller 72, and seal assembly 74 (FIG. 6). Adapter 70 is mounted to engine 22 by bolts 76 or other suitable mounting means. Adapter 70 is used to provide a top surface for pumping chamber 36 so that the bottom of engine 22 is not in immediate contact with the pumping fluid. In order to effectively seal the joint between impeller 72 and shaft 24, seal assembly 74, which is comprised of washers 78, O-ring 80, and sealing elements 82, is provided.

Figure 3:
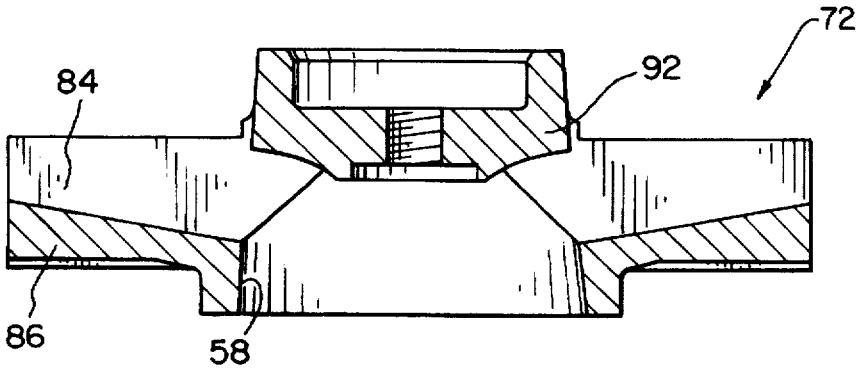
FIG. 3 is a sectional view of the impeller taken along line 3—3 of FIG. 2.
Figure 2:
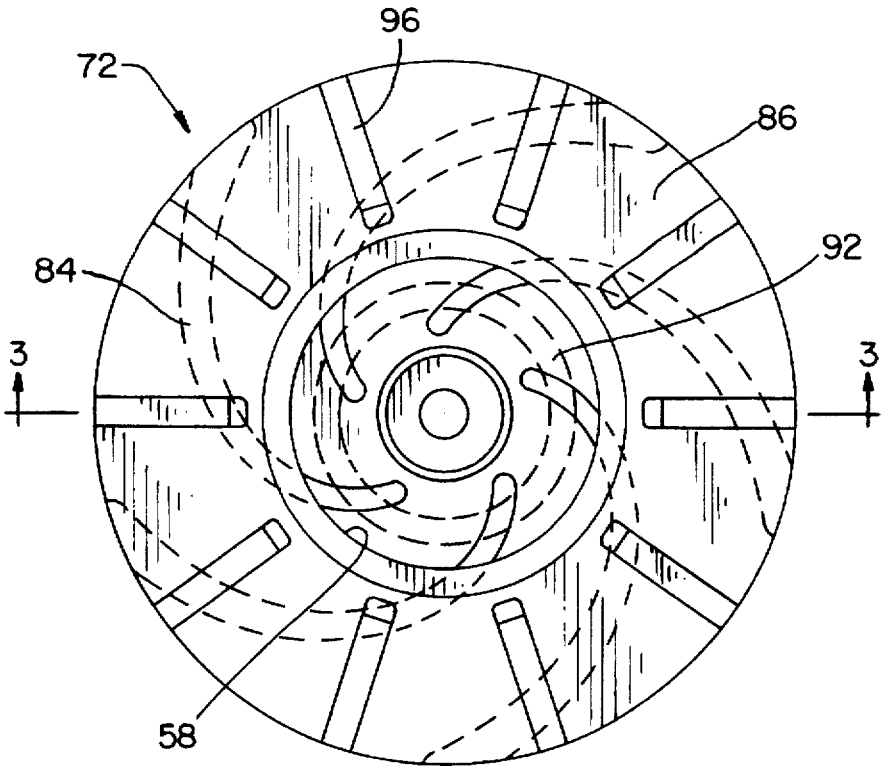
FIG. 2 is a bottom view of the impeller shown in FIG. 1.

Referring now to FIGS. 2 and 3, impeller 72 is shown having arcuate vanes 84 provided thereon to push the liquid as the impeller is rotating. In the exemplary embodiment, an impeller having one shroud 86, commonly referred to as a "semi-open impeller", is used. Shroud 86 is provided on impeller 44 on the side of impeller 72 opposite engine 22 in order to reduce the downward axial load on engine bearing 88 (FIG. 1). The downward axial load results from engine 22, engine flywheel 30, shaft 24, and impeller assembly 26. A substantial axial load is therefore placed on bearing 88 of engine 22, which is typically in excess of the load capacity of standard engine bearings. By placing shroud 86 on the side of the impeller opposite engine 22, the downward axial load is counteracted by the upward thrust generated by impeller 26 as described with greater detail herein. The axial load on bearing 88 of engine 22 is thereby reduced.

During the operation of pump 20, liquid enters between vanes 84 of impeller 72 through center aperture 58 in the hub area of shroud 86. The centrifugal force generated by impeller 72 increases the pressure and velocity of the liquid as the liquid travels to the outer circumference of impeller 72. Maximum pressure and velocity is attained at the outer circumference of impeller 72. The area between the bottom of shroud 86 and the pump housing (area 90 shown in FIG. 1) is in communication with the high pressure liquid at the outer circumference of impeller 72 and is therefore a high pressure area. The area above shroud 86 between center aperture 58 and the outer circumference of the impeller has a lower pressure than area 90. The pressure within area 90 therefore pushes upward against shroud 86 and therefore creates an upward thrust which pushes impeller 72 upward toward engine 22, and in the direction opposite to the downward axial load created by engine 22 and impeller assembly 26.

The net result of this design is that bearing 88 of engine 22 is able to operate efficiently due to the balancing of the downward axial load and the upward thrust generated by impeller 72. Impeller 72 is also provided with mounting boss 92 forming a hub which serves as a seat for seal assembly 74 which is itself mounted annularly about the circumference of shaft 24. Finally, impeller assembly 26 is secured to shaft 24 by connecting bolt 94.

In order for the present invention to be able to employ a conventional vertical shaft engine having a standard weight flywheel, additional mass is added to shroud 86 of impeller 72, by thickening shroud mainly at the outer circumference thereof (FIG. 3). Impeller 72 therefore has sufficient mass to carry four-stroke engine 22 through a compression stroke during which engine 22 is not generating force. This is similar to the operation of a lawn mower wherein the vertical shaft engine has a blade rotating therewith. Otherwise, a heavy flywheel, at added expense, would have to be used to provide the necessary mass. Impeller 72 includes slots 96 (FIG. 2).

In operation, vertical shaft pump 20 is stationed above the level of the liquid to be pumped. A suction hose or other means is connected to pump 20 to communicate the liquid to be pumped to pump inlet 40. A similar hose or pumping conduit is connected from pump outlet 66 to the area or container receiving the pumped liquid. Pump 20 will initially be filled through fill port 98 to a level sufficient to fill pumping chamber 36, but low enough to be below pump outlet 66. Fill port 98 will then be closed using threaded bung 100. When engine 22 is started, shaft 24 will rotate which, in turn, will rotate impeller 72 within pumping chamber 36. The rotation of impeller 72 will create a centrifugal force within pumping chamber 36 which will draw the liquid toward the periphery of impeller 72 to curved wall 60 and ultimately into diffuser passage 62. As the liquid exits pumping chamber 36, a continuous supply of liquid enters through the suction hose and pump inlet chamber 34.

From diffuser passage 62, the liquid will pass into quiet zone 64 of separation chamber 38 wherein the lessening velocity of the liquid and the difference in densities between gas and liquid will allow the gas to rise and the liquid to fall. The gas will ultimately leave vertical shaft pump 20 through pump outlet 66 of tower 68, whereas the liquid will reenter pumping chamber 36. The separated liquid will then mix with additional liquid having entrained gas therein and enter pumping chamber 36 through central aperture 54 of bottom wall 56. As before, centrifugal force will draw the liquid to the outer periphery of impeller 72 to curved wall 60 and ultimately to diffuser passage 62. Once substantially all the entrained gas is removed, the flow rate of pump 20 will accelerate, thereby forcing more liquid into separation chamber 38 and ultimately into tower 68 where the liquid will be able to exit pump 20 through pump outlet 66.

While this invention has been described as having a particular design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains, and which fall within the limits of the appended claims.

What is claimed is:

1. A centrifugal pump, comprising:

an engine having a vertically disposed drive shaft rotatably mounted within bearings;

a pump housing, said engine being attached to said pump housing with said drive shaft extending downwardly into said pump housing;

an impeller attached to said vertical drive shaft and rotatable within said pump housing, said impeller and said shaft placing a downward load on said engine bearings, said impeller having a shroud, a central aperture, an outer circumference, and a plurality of vanes, said shroud being perpendicular to said vertical drive shaft and having a first side and an opposed second side, said first side disposed adjacent said engine, said vanes being radially disposed on said first side, said second side disposed adjacent said pump housing with a pressure area disposed between said second side and said pump housing;

whereby fluid being pumped passes through said central aperture in said impeller and is expelled radially outward by said vanes to said outer circumference of said impeller, fluid between said central aperture and said outer circumference having a lower pressure than fluid at said outer circumference, said pressure area being in fluid communication with fluid at said outer circumference and thereby having a relatively high pressure, said high pressure area thereby placing an upward thrust on said second side of said impeller to counteract against the downward load resulting from said shaft and said impeller, the downward load on said engine bearings thereby being reduced.

2. The centrifugal pump of claim 1, wherein said impeller vanes are arcuate, said vanes pushing fluid radially outward as said impeller rotates.

3. The centrifugal pump of claim 1 wherein said impeller has a central hub area and a shroud, and the thickness of said shroud in an axial direction at the outer periphery of said impeller is greater than the thickness of said shroud at a position radially intermediate the hub area and the outer circumference to thereby peripherally weight said impeller.

4. A centrifugal pump, comprising:

an engine having a vertically disposed drive shaft and a flywheel;

a pump housing, said engine being attached to said pump housing with said drive shaft extending downwardly into said pump housing; and an impeller attached to said vertical drive shaft and rotatable within said pump housing, said impeller having a plurality of vanes, said vanes engaging a medium being pumped and forcing the medium radially outward upon rotation of said impeller;

said impeller having a central hub area, said impeller, including a shroud wherein the thickness of said shroud in an axial direction at the outer circumference of said impeller is greater than the thickness of said shroud at a position radially intermediate the hub area and the outer circumference to thereby peripherally weight said impeller.

5. The centrifugal pump of claim 4, wherein said impeller vanes are arcuate.

6. The pump of claim 4 wherein said impeller includes a central aperture therein, and fluid is pumped through said central aperture and expelled radially by said vanes.

* * * * *